US006786769B2

(12) United States Patent
Lai

(10) Patent No.: US 6,786,769 B2
(45) Date of Patent: Sep. 7, 2004

(54) METAL SHIELDING MASK STRUCTURE FOR A CONNECTOR HAVING AN ANTENNA

(75) Inventor: Eric Lai, Jungli (TW)

(73) Assignee: Jomax Electronics Co. Ltd., Pinjen (TW)

( * ) Notice: Subject to any disclaimer, the term of this patent is extended or adjusted under 35 U.S.C. 154(b) by 0 days.

(21) Appl. No.: 10/414,051

(22) Filed: Apr. 16, 2003

(65) Prior Publication Data

US 2004/0048515 A1 Mar. 11, 2004

(30) Foreign Application Priority Data

Sep. 9, 2002 (TW) ..... 91214066 U

(51) Int. Cl.[7] ..... H01R 13/58

(52) U.S. Cl. ..... 439/607; 439/916; 343/906; 343/841

(58) Field of Search ..... 439/607, 916; 343/906, 700 MS, 841, 842

(56) References Cited

U.S. PATENT DOCUMENTS 5,585,806 A * 12/1996 Ogino et al. ..... 343/700 MS
5,874,920 A * 2/1999 Araki et al. ..... 343/702
6,204,825 B1 * 3/2001 Wilz ..... 343/841
6,215,457 B1 * 4/2001 Losey ..... 343/906
6,307,513 B1 * 10/2001 Gaucher et al. ..... 343/702
6,384,793 B2 * 5/2002 Scordilis ..... 343/767
6,417,817 B1 * 7/2002 Pirila et al. ..... 343/841
6,639,560 B1 * 10/2003 Kadambi et al. .... 343/700 MS

* cited by examiner

*Primary Examiner*—Ross Gushi
(74) *Attorney, Agent, or Firm*—Bacon & Thomas, PLLC

(57) ABSTRACT

The invention relates to an improved metal shielding mask for a connector having an antenna, comprising a hollow metal shielding mask formed of an upper sheet portion and a lateral sheet portion, wherein an antenna is formed by extending a predefined length of a metal plate in a vertical or horizontal direction from a predetermined position at a lower end of a side of the upper sheet portion, a signal feeding terminal for the antenna of the metal shielding masks formed of an I shaped extension portion which is externally extended from a top end of a side of the upper sheet portion along one end of the antenna, and a ground terminal for the metal shielding is formed of a plurality of I shaped extension portions which are respectively extended externally from both sides of the lateral sheet portion as the metal shielding mask is bent.

1 Claim, 4 Drawing Sheets

E-Plane
Field Pattern
Frequency:2.45GHz

H-Plane
Field Pattern
Frequency:2.45GHz

Return Loss

SWR

METAL SHIELDING MASK STRUCTURE FOR A CONNECTOR HAVING AN ANTENNA

BACKGROUND OF THE INVENTION

Typically, the connector has been widely employed in electrically conductive connections for a variety of power supplies and signals. Recently, due to rapid developments of computers and its peripherals, structure of the connectors is allowed to have a great number of variations. However, all of these variations fall in a basic configuration that two corresponding terminals are connected with each other by plug-in, such that each electrical contact inside the connector may form a conductive connection.

In each connector for communication, for effectively improving a communication quality, allowing adjacent signal lines to be substantially isolated for prevention of the cross talk, it normally provides a metal shielding mask on the outside of the connector and electrically connects the metal shielding mask to a common ground.

Therefore, the present invention relates to an improved metal shielding mask structure for a connector having an antenna, more specifically, to an improved metal shielding mask structure which is designed to have a structure and function of an antenna and allowed to be formed in unity for connection with an upper sheet portion on a metal shielding mask to increase functions of the metal shielding mask.

SUMMARY OF THE INVENTION

An object of the present invention is to provide an improved metal shielding mask structure which is designed by pressing and cutting an upper sheet portion of the metal shielding mask into a structure of antenna such that the structure of the antenna is connected to the upper sheet portion of the metal shielding mask in unity, in order to simplify manufacturing process and greatly raise the function of the metal shielding mask.

In accordance with the present invention, an improved metal shielding mask comprises: an I shaped extension portion, externally extended from a top end on a side of an upper portion which is located on a hollow body of the metal shielding mask formed by the upper sheet portion and a lateral sheet portion that are all bent; a plurality of I shaped extension portion, externally extended from both sides of the lateral sheet portion respectively, in that when the body is bent to form a metal shielding mask, the I shaped extension portions vertically form a signal feeding terminal and a ground terminal of antenna for the metal shielding mask downwards.

Another object of the present invention is to provide an improved metal shielding mask capable of increasing functions of a connector and reducing cost to satisfy an economic utility due to identical process for metal shielding masks without additional work.

The embodiments of the present invention are described in detail as following in conjunction with these drawings.

Figure 1:
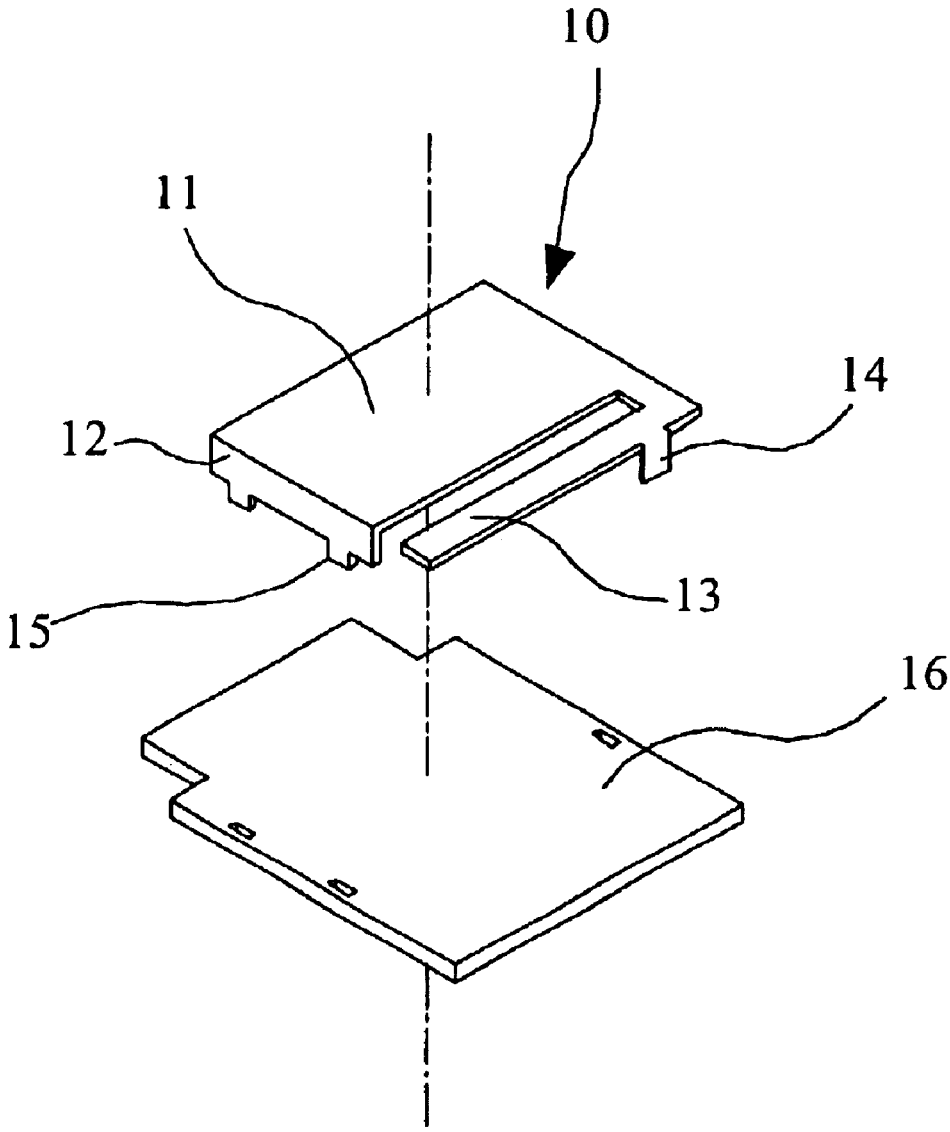
FIG. 1 is a perspective view, showing a first embodiment of a metal shielding mask of a connector in accordance with the present invention.

| LIST OF REFERENCE NUMERALS | |
|---|---|
| 10 | metal shielding mask |
| 11 | upper sheet portion |
| 12 | lateral sheet portion |
| 13 | antenna |
| 14 | signal feeding terminal of antenna |
| 15 | ground terminal |
| 16 | printed circuit board |
| 20 | metal shielding mask |
| 21 | upper sheet portion |
| 22 | lateral sheet portion |
| 23 | antenna |
| 24 | signal feeding terminal of antenna |
| 25 | ground terminal |
| 26 | printed circuit board |

DETAILED DESCRIPTION OF THE PREFERRED EMBODIMENT

As shown in FIG. 1, FIG. 1 shows an embodiment in accordance with the present invention, which employs a metal shielding mask 10 of a typical USB connector. The metal shielding mask 10 shown in FIG.1 comprise a hollow metal shielding mask, formed of an upper sheet portion 11 and two lateral sheet portions 12 with edges of which are bent; an antenna 13, which is formed by cutting a slot in a horizontal direction from a predetermined position at a lower edge of a top end of the upper sheet portion 11 such that the top end of the upper sheet portion 11 has a metal plate with a predefined length, in that an I shaped extension portion is externally extended from the top end on a side of the upper sheet portion 11 so as to form a signal feeding terminal 14 of the antenna 13 of the metal shielding mask, and a plurality of I shaped extension portions are respectively extended externally form both sides of the lateral sheet portion 12 to form a ground terminal 15 of the metal shielding mask as the metal shielding mask is bent in shape, wherein when the signal feeding terminal 14 of the antenna 13 and the ground terminal 15 are embedded in a printed circuit board 16, they can form supports to support the metal shielding mask for a connector.

Figure 2:
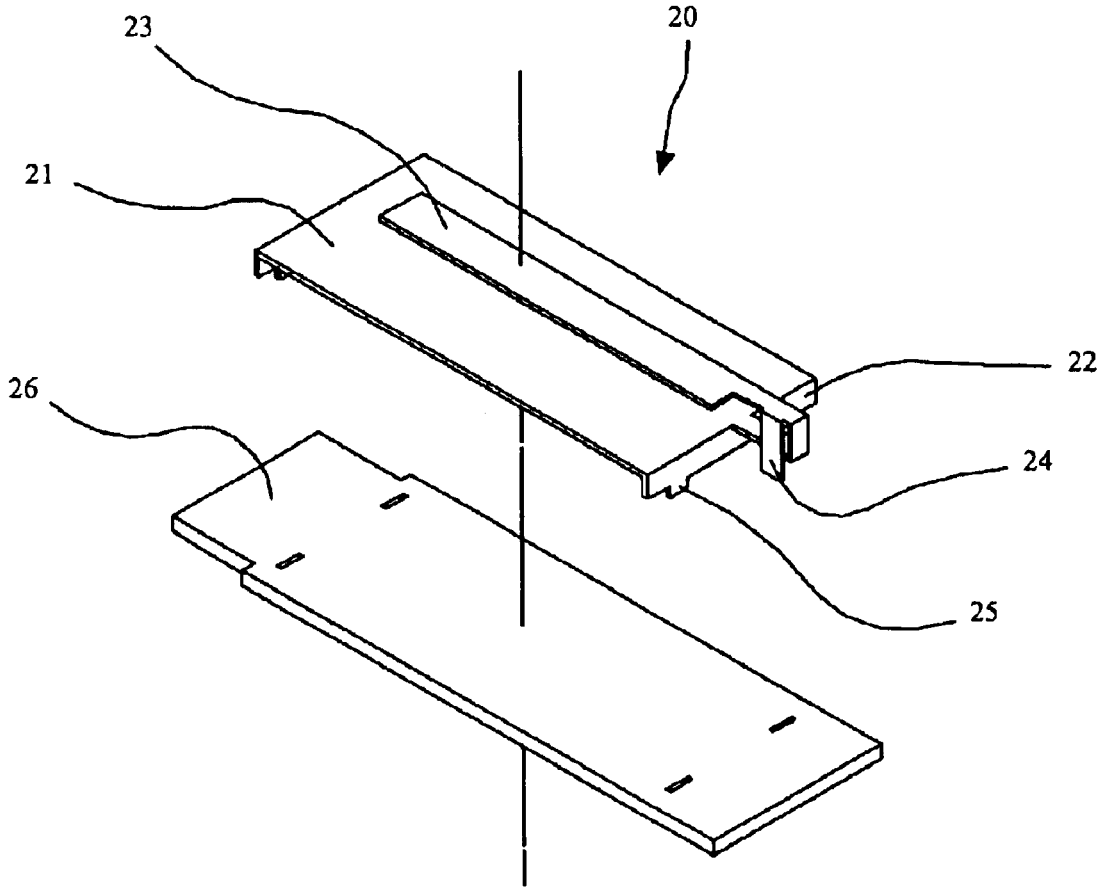
FIG. 2 is a perspective view, showing a second embodiment of a metal shielding mask of a connector in accordance with the present invention.

As show in FIG. 2, FIG. 2 shows an embodiment in accordance with the present invention, which employs a metal shielding mask 20 of an elongated USB connector. The metal shielding mask 20 as shown in FIG. 2 comprises a hollow metal shielding mask, formed of an upper sheet portion 21 and two lateral sheet portions 22 with edges of which are bent; an antenna 23, which is formed by extending a predefined length of a metal plate in a vertical direction from a predetermined position at a top end on the upper sheet portion 21 and bending the metal plate by 180° in reverse, in that an I shaped extension portion is externally extended from one end of the antenna 23 so as to form a signal feeding terminal 24 of the antenna 23 of the metal shielding mask, and a plurality of I shaped extension portions are respectively extended externally from both sides of the lateral sheet portion 22 to form a ground terminal 25 of the metal shielding mask as the metal shielding mask is bent in shape, wherein when the signal feeding terminal 24 of the antenna 23 and the ground terminal 25 are embedded in a printed circuit board 16, they can form supports to support the metal shielding mask for a connector.

Figure 3:
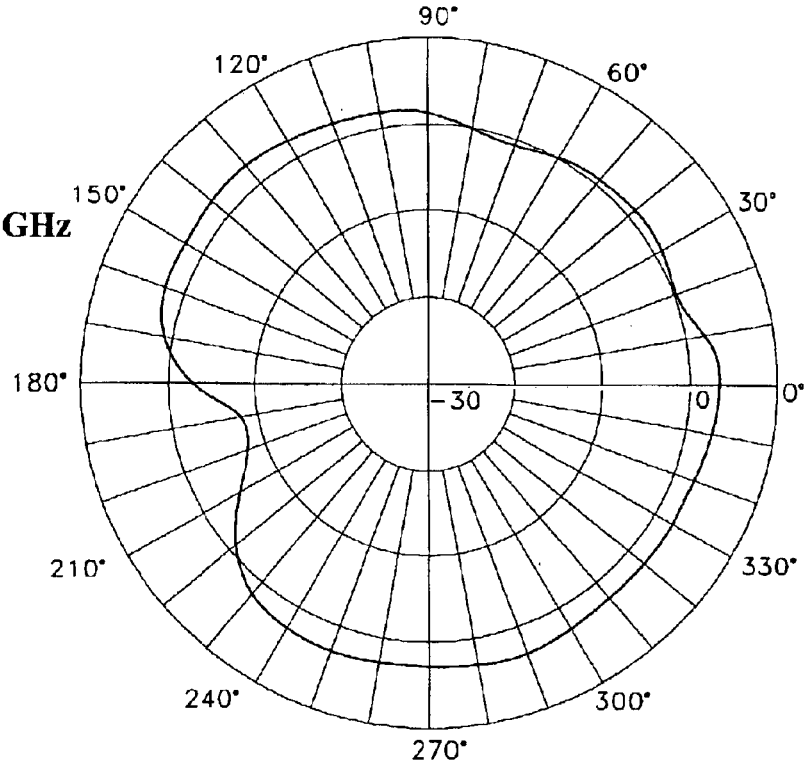
FIG. 3 shows an E-plane radiation field pattern of the present invention.
Figure 4:
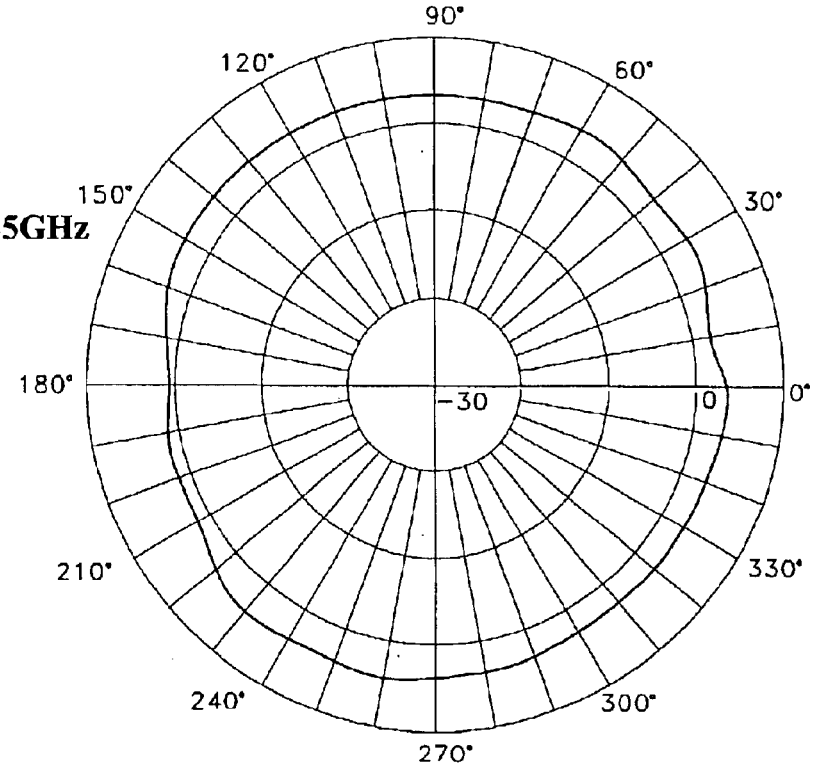
FIG. 4 shows a H-plane radiation field pattern of the present invention.
Figure 5:
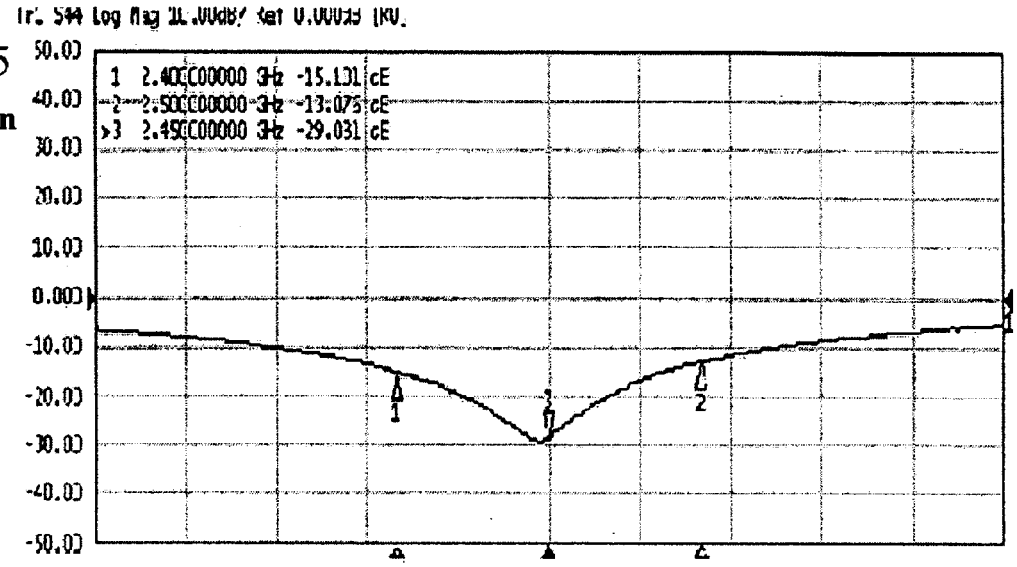
FIG. 5 shows a test result of a return loss of the present invention.
Figure 6:
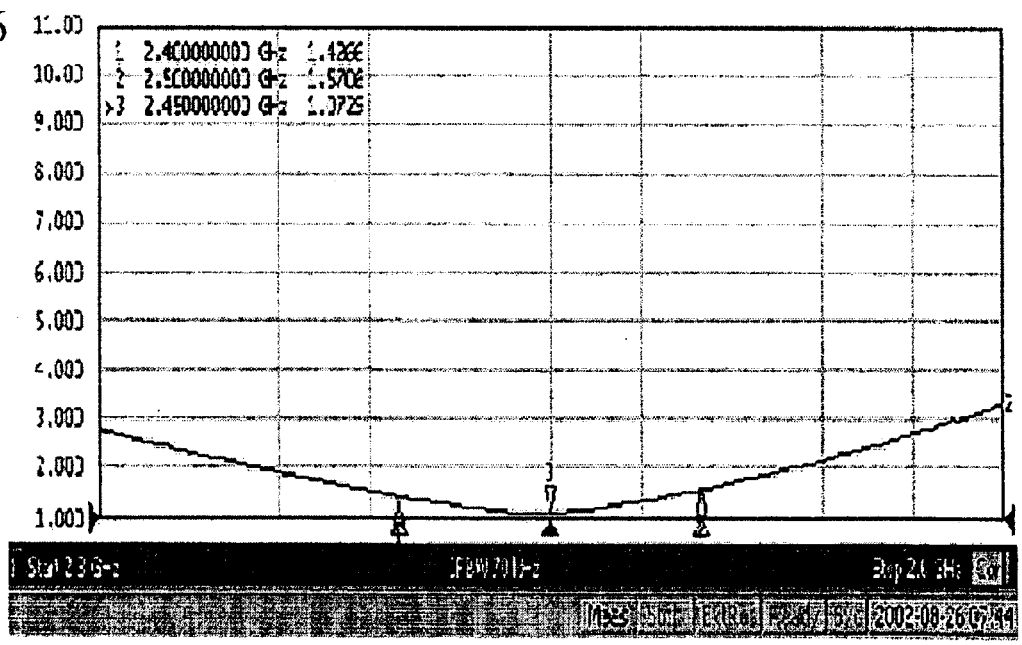
FIG. 6 shows a test result of a SWR of the present invention.

FIGS. 3 and 4 respectively show E-plane and H-plane field patterns in accordance with the present invention, at 2.45 GHz of a used radiation frequency band. In FIGS. 3 and 4 represent test reports for radiation gain of the present invention, the generated radiation gain of which is approximately 2.0 dBi. FIGS. 5 and 6 show test results of return loss and SWR (standing wave ratio) of the present invention. In figures, the return loss is shown less than −10 dB and the SWR is less than 2.0 in the frequency range of 2.4 GHz~2.5 GHz, which actually have preferable efficacies.

In practice, the manufacturing process of the metal shielding mask in accordance with the present invention is similar to that of the conventional metal shielding mask without any further work. While the metal shielding mask is bent according to the invention, it can greatly increase the function for a product. The present invention is not limitted in the USB connections, which are exemplified by these embodiments. The present invention can be utilized in the field of connectors including RF modules.

Summing up the above, the present invention indeed achieves an expected efficacy and object. The detailed description can be implemented by these people who is skillful in this field. However, the embodiments described on above are simply used for illustrative purpose. The change of all equivalent structure and the modification made within the spirit of the invention should be considered as falling in the scope of the invention.

Thus, the patent application with the specification is submitted for the examination according to the Patent Law.

What is claimed is:

1. An improved metal shielding mask for a connector having an antenna, comprising a hollow metal shielding mask formed of an upper sheet portion and a lateral sheet portion, the characteristics in that:

an antenna is formed by extending a predefined length of a metal plate in a vertical or horizontal direction from a predetermined position at a lower end of a side of the upper sheet portion;

a signal feeding terminal, for the antenna of the metal shielding mask, is formed of an I shaped extension portion which is externally extended from a top end of a side of the upper sheet portion along one end of the antenna; and a ground terminal, for the metal shielding mask, is form of a plurality of I shaped extension portions, which are respectively extended externally from both sides of the lateral sheet portion as the metal shielding mask is bent.

* * * * *